US006579418B2

(12) United States Patent
Lindsay et al.

(10) Patent No.: US 6,579,418 B2
(45) **Date of Patent: *Jun. 17, 2003**

(54) LEAKAGE CONTROL SYSTEM FOR TREATMENT OF MOVING WEBS

(75) Inventors: Jeffrey Dean Lindsay, Appleton, WI (US); Michael Alan Hermans, Neenah, WI (US); Frank Stephen Hada, Appleton, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/899,314

(22) Filed: Jul. 5, 2001

(65) Prior Publication Data

US 2002/0060018 A1 May 23, 2002

Related U.S. Application Data

(63) Continuation of application No. 09/133,064, filed on Aug. 12, 1998, now Pat. No. 6,280,573.

(51) Int. Cl.[7] ..... D21F 3/00; F26B 25/00

(52) U.S. Cl. ..... 162/198; 34/242; 34/405; 162/252; 162/262; 162/263; 422/292; 422/295; 422/297; 8/101; 8/115.51

(58) Field of Search ..... 162/198, 199, 162/252, 262, 263; 34/242, 405; 73/40; 422/292, 295, 297; 8/101, 115.51

(56) References Cited

U.S. PATENT DOCUMENTS 1,297,192 A 3/1919 Le Roy et al.
1,718,573 A 6/1929 Milspaugh (List continued on next page.)

FOREIGN PATENT DOCUMENTS

CA 677083 12/1963
EP 0 033 559 A2 8/1981

(List continued on next page.)

OTHER PUBLICATIONS

Bieman, Leonard H., Kevin G. Harding, and Albert Boehnlein, "Absolute Measurement Using Field Shifted Moreé", *Optics, Illumination, and Image Sensing for Machine Vision VI*, SPIE Proceedings Series, Nov. 14–15, 1991, vol. 1614, pp. 259–264.

(List continued on next page.)

*Primary Examiner*—Peter Chin
(74) *Attorney, Agent, or Firm*—Patricia A. Charlier; Thomas M. Gage

(57) ABSTRACT

Pressurized web treatment systems include a moving web that passes through a pressurized treatment chamber having a sealing assembly with a leakage control system. Leakage control is achieved by the cooperative effect of localized leak detectors and leak reduction means that applies a local sealing force on the seal assembly responsive to a signal from the leak detectors such that increased sealing occurs in the vicinity of the leak. In particular, an air press for paper web dewatering has improved efficiency by virtue of the leakage control system, which features local leak detectors and local force generation means associated with a flexible seal assembly to reduce leakage at the edges of the stationary plenum of the air press. Local leak detection can be based on sonic measurement with microphones, detection of escaping tracer gas, optical signals, and other means. Other embodiments of web treatment systems include those for continuous production of activated carbon fabrics and steam and chemical treatment of textiles and other fibrous webs.

26 Claims, 4 Drawing Sheets

U.S. PATENT DOCUMENTS

| | | | |
|---|---|---|---|
| 2,091,805 | A | 8/1937 | Chuse |
| 2,861,354 | A | 11/1958 | Hultgreen |
| 2,926,116 | A | 2/1960 | Keim |
| 3,052,991 | A | 9/1962 | Goldner |
| 3,058,873 | A | 10/1962 | Keim et al. |
| 3,084,448 | A | 4/1963 | Dungler |
| 3,176,412 | A | 4/1965 | Gardner |
| 3,208,158 | A | 9/1965 | Smith, Jr. |
| 3,220,914 | A | 11/1965 | Broadway et al. |
| 3,224,926 | A | 12/1965 | Bernardin |
| 3,224,928 | A | 12/1965 | Lee et al. |
| 3,303,576 | A | 2/1967 | Sisson |
| 3,319,354 | A | 5/1967 | Hering, Jr. et al. |
| 3,340,617 | A | 9/1967 | Carroll, Jr. |
| 3,371,427 | A | 3/1968 | Thygeson, Sr. |
| 3,434,922 | A | 3/1969 | Ely |
| 3,455,778 | A | 7/1969 | Bernardin |
| 3,537,954 | A | 11/1970 | Justus |
| 3,541,697 | A | 11/1970 | Villalobos |
| 3,574,261 | A | 4/1971 | Bailey |
| 3,577,651 | A | 5/1971 | Nichols |
| 3,587,177 | A | 6/1971 | Overly |
| 3,599,341 | A | 8/1971 | Darcy |
| 3,607,624 | A | 9/1971 | Moody et al. |
| 3,617,442 | A | 11/1971 | Hurschman |
| 3,629,056 | A | 12/1971 | Forrest |
| 3,771,236 | A | 11/1973 | Candor et al. |
| 3,771,239 | A | 11/1973 | Minoda et al. |
| 3,812,598 | A | 5/1974 | Lefebvre et al. |
| 3,822,182 | A | 7/1974 | Heyse et al. |
| 3,844,881 | A | 10/1974 | Moody |
| 3,849,904 | A | 11/1974 | Villalobos |
| 3,895,449 | A | 7/1975 | Chance et al. |
| 3,913,241 | A | 10/1975 | Chaikin et al. |
| 3,923,593 | A | 12/1975 | Verseput |
| 3,930,319 | A | 1/1976 | Coleman |
| 3,994,771 | A | 11/1976 | Morgan, Jr. et al. |
| 4,072,557 | A | 2/1978 | Schiel |
| 4,074,441 | A | 2/1978 | Helversen et al. |
| 4,102,737 | A | 7/1978 | Morton |
| 4,120,747 | A | 10/1978 | Sarge, III et al. |
| 4,121,968 | A | 10/1978 | Wells |
| 4,125,430 | A | 11/1978 | Grossman |
| 4,163,688 | A | 8/1979 | Kankaanpaa |
| 4,183,147 | A | 1/1980 | Kawaguchi |
| 4,197,973 | A | 4/1980 | Daane |
| 4,201,323 | A | 5/1980 | Stibbe et al. |
| 4,309,246 | A | 1/1982 | Hulit et al. |
| 4,345,385 | A | 8/1982 | Sando et al. |
| 4,356,059 | A | 10/1982 | Hostetler |
| 4,361,466 | A | 11/1982 | Wong et al. |
| 4,364,185 | A | 12/1982 | Dussourd et al. |
| 4,421,600 | A | 12/1983 | Hostetler |
| 4,440,597 | A | 4/1984 | Wells et al. |
| 4,462,868 | A | 7/1984 | Oubridge et al. |
| 4,528,316 | A | 7/1985 | Sorens |
| 4,529,480 | A | 7/1985 | Trokhan |
| 4,541,895 | A | 9/1985 | Albert |
| 4,551,199 | A | 11/1985 | Weldon |
| 4,556,450 | A | 12/1985 | Chuang et al. |
| 4,559,105 | A | 12/1985 | Sennett et al. |
| 4,571,359 | A | 2/1986 | Dutt |
| 4,637,859 | A | 1/1987 | Trokhan |
| 4,787,641 | A | 11/1988 | Rautakorpi et al. |
| 4,835,880 | A | 6/1989 | Vecchia |
| 4,849,054 | A | 7/1989 | Klowak |
| 4,871,425 | A | 10/1989 | Gunderson |
| 4,892,622 | A | 1/1990 | Malkki et al. |
| 4,915,788 | A | 4/1990 | Winheim |
| 4,953,297 | A | 9/1990 | Eskelinen et al. |
| 4,976,821 | A | 12/1990 | Laapotti |
| 4,986,009 | A | 1/1991 | Haessner et al. |
| 5,048,589 | A | 9/1991 | Cook et al. |
| 5,070,627 | A | 12/1991 | Zagar |
| 5,070,628 | A | 12/1991 | Zagar |
| 5,078,835 | A | 1/1992 | Schiel et al. |
| 5,085,737 | A | 2/1992 | Brogyanyi et al. |
| 5,105,562 | A | 4/1992 | Hella et al. |
| 5,129,988 | A | 7/1992 | Farrington, Jr. |
| 5,137,600 | A | 8/1992 | Barnes et al. |
| 5,187,219 | A | 2/1993 | Furman, Jr. |
| 5,225,042 | A | 7/1993 | Eaton et al. |
| 5,230,776 | A | 7/1993 | Andersson et al. |
| 5,262,010 | A | 11/1993 | Bubik et al. |
| 5,274,930 | A | 1/1994 | Ensign et al. |
| 5,336,373 | A | 8/1994 | Scattolino et al. |
| 5,348,620 | A | 9/1994 | Hermans et al. |
| 5,381,580 | A | 1/1995 | Kotitschke et al. |
| 5,411,636 | A | 5/1995 | Hermans et al. |
| 5,471,765 | A | 12/1995 | Rautakorpi et al. |
| 5,490,903 | A | 2/1996 | Chen et al. |
| 5,501,768 | A | 3/1996 | Hermans et al. |
| 5,508,095 | A | 4/1996 | Allum et al. |
| 5,556,053 | A | 9/1996 | Henseler |
| 5,598,643 | A | 2/1997 | Chuang et al. |
| 5,601,871 | A | 2/1997 | Krzysik et al. |
| 5,607,551 | A | 3/1997 | Farrington, Jr. et al. |
| 5,625,961 | A | 5/1997 | Ensign et al. |
| 5,656,132 | A | 8/1997 | Farrington, Jr. et al. |
| 5,667,636 | A | 9/1997 | Engel et al. |
| 5,743,999 | A | 4/1998 | Kamps et al. |
| 5,746,887 | A | 5/1998 | Wendt et al. |
| 5,772,845 | A | 6/1998 | Farrington, Jr. et al. |
| 5,830,321 | A | 11/1998 | Lindsay et al. |
| 5,990,377 | A | 11/1999 | Chen et al. |
| 6,080,279 | A | 6/2000 | Hada et al. |
| 6,080,691 | A | 6/2000 | Lindsay et al. |
| 6,083,346 | A | 7/2000 | Hermans et al. |
| 6,093,284 | A | 7/2000 | Hada et al. |
| 6,096,169 | A | 8/2000 | Hermans et al. |
| 6,120,642 | A | 9/2000 | Lindsay et al. |
| 6,143,135 | A | 11/2000 | Hada et al. |
| 6,149,767 | A | 11/2000 | Hermans et al. |
| 6,187,137 | B1 | 2/2001 | Druecke et al. |
| 6,197,154 | B1 | 3/2001 | Chen et al. |
| 6,228,220 | B1 | 5/2001 | Hada et al. |
| 6,280,573 | B1 | 8/2001 | Lindsay et al. |
| 6,306,257 | B1 | 10/2001 | Hada et al. |

FOREIGN PATENT DOCUMENTS

| | | |
|---|---|---|
| EP | 0 328 227 A2 | 8/1989 |
| EP | 0 502 602 A1 | 9/1992 |
| EP | 0 574 366 A1 | 12/1993 |
| EP | 0 616 074 A1 | 9/1994 |
| FR | 679469 | 1/1930 |
| FR | 1 235 868 | 5/1960 |
| FR | 2 303 116 | 10/1976 |
| GB | 1057373 | 2/1967 |
| GB | 2 152 961 A | 8/1985 |
| GB | 2 179 949 A | 3/1987 |
| GB | 2 179 953 A | 3/1987 |
| GB | 2 235 754 A | 3/1991 |
| GB | 2 254 288 B | 11/1994 |
| WO | WO 90/04676 A1 | 5/1990 |
| WO | WO 91/16493 A1 | 10/1991 |
| WO | WO 93/23616 A1 | 11/1993 |
| WO | WO 97/43483 A1 | 11/1997 |

OTHER PUBLICATIONS

Bowden, Edward V., "Non–Contact Drying and Turning—the 'On Machine' Technology of the Nineties", *Appita*, vol. 44, No. 1, Jan. 1991, pp. 41–46.

Haberl, Andrew et al., "First Linerboard Application Of The Gas Heated Paper Dryer", *45th Appita Annual General Conference Proceedings*, vol. 1, 1991, pp. 47–50.

Kufferath, W. et al., "Die Sonic–Roll", *Das Papier*, 42(10A): V140, 1988.

Lindsay, Jeffrey D. and Leonard H. Bieman, "Exploring Tactile Properties of Tissue With Moire Interferometry", *Non–Contact, Three–Dimensional Gaging Methods and Technologies Workshop*, Dearborn, Michigan, Mar. 1997.

Lindsay, Jeffrey D., "Displacement Dewatering To Maintain Bulk", *Paperi Ja Puu—Paper And Timber*, vol. 74, No. 3, 1992, pp. 232–242.

Mummery, Leigh, *Surface Texture Analysis: The Handbook*, published by Hommelwerke GmbH, Muhlhausen, Germany, 1990, pp. 37–45.

Page, R.H. and J. Seyed–Yagoobi, "A New Concept For Air Or Vapor Impingement Drying", *Tappi Journal*, 73(9), Sep. 1990, pp. 229–234.

TAPPI Official Test Method T 494–om–88, "Tensile Breaking Properties Of Paper And Paperboard (Using Constant Rate Of Elongation Apparatus)", publishing by the TAPPI Press, Atlanta, Georgia, revised 1988, pp. 1–5.

TAPPI Useful Method UM 256, "Water Retention Value (WRV)", published by the TAPPI Press, Atlanta, Georgia, pp. 54–56.

Thiele, P.E. and R.H. Page, "Enhancement Of Drying Rate, Moisture Profiling And Sheet Stability On An Existing Machine With RJR Blow Boxes", *1995 Papermakers Conference*, Tappi Press, Atlanta, Georgia, 1995, pp. 223–228.

LEAKAGE CONTROL SYSTEM FOR TREATMENT OF MOVING WEBS

This application is a continuation of application Ser. No. 09/133,064 entitled LEAKAGE CONTROL SYSTEM FOR TREATMENT OF MOVING WEBS and filed in the U.S. Patent and Trademark Office on Aug. 12, 1998 now U.S. Pat. No. 6,280,573. The entirety of application Ser. No. 09/133,064 is hereby incorporated by reference.

BACKGROUND OF THE INVENTION

Many devices exist for performing an operation on a moving web wherein a gas or gas pressure differential is applied. For example, in the art of papermaking, a wet or embryonic paper web can be partially dried or dewatered by means of an applied gas pressure differential using nozzles, a compressive roll with holes or grooves for pressurized air, an "air press" or other devices wherein a gas pressure differential forces air into a web to displace liquid water and/or to remove water by evaporation. Many prior systems, particularly those having compressive rolls, impose high compressive force on the web and are not suitable for many low density materials such as tissue. Systems of nozzles are typically inadequate due to the low residence time provided for air penetration into the web. Nozzle systems also either suffer from high leakage if the nozzle is not in contact with the web or from high fabric wear if the fabric wraps the surfaces of the nozzle to provide some degree of sealing. A fabric wrapping a nozzle with a small effective radius of curvature is particularly likely to experience wear problems.

Flat pressurized boxes, such as steam boxes, while capable of good residence time in some cases, suffer from high leakage from the sides of the steam chamber. Steam boxes for heating paper webs in particular have tended to be flat boxes with a finite gap between the web and the sides of the box. Such gaps or clearances allow significant volumes of air to enter, in part due to the air boundary layer traveling with the web. Intentionally bleeding steam to oppose the boundary layer or using a steam curtain to prevent entry of the boundary layer is inherently inefficient.

Recognizing the difficulty of providing adequate seals in pressurized paper drying chambers, some have proposed the use of high-velocity heated air impingement that relies on the momentum of the air to push through the web for paper drying without attempting to use seals. This technique is intended to minimize lateral migration of the drying air along the surface of the web, thereby reducing the need for sealing. Even if this method reduces the lateral flow of air, the extent of treatment is limited by the brief contact time of the pressurized gas with the web due to the narrow jets employed. Without suitable seal elements, leakage still will not be prevented.

Rotary devices, such as cylindrical through dryers and suction rolls, can be operated to pass air through a fibrous sheet but are complex and costly devices. Further, the surface of the rotary device or other supporting surfaces in contact with the web have significant closed areas where gas flow is blocked, resulting in nonuniform penetration of the gas through the web.

An excellent system for effective gas treatment of a moving web is the dewatering system disclosed in commonly owned copending application Ser. No. 08/961,915 of Hada et al. filed Oct. 31, 1997 and incorporated herein by reference in its entirety. This application teaches an air press wherein a non-rotating upper plenum is used to apply pressurized air to a moist paper web while the web is sandwiched between two pervious fabrics. The pressurized plenum cooperates with a lower vacuum box on the opposite side of the sandwiched paper web such that the overall pressure differential across the web is greater than if the pressurized plenum were used alone at a predetermined pressure. An important issue in the operation of an air press is preventing unnecessary leakage of gas out of the plenum into the surrounding atmosphere. Hada et al. disclose a set of cross-direction seals (seals running in the cross-direction) for the leading and trailing edges of the plenum (the leading edge being closest to the headbox) and a pair of machine-direction seals running in the machine direction to seal the side edges of the plenum. Hada et al. also disclose a lever system for increasing sealing force on the seals responsive to measurement of air pressure in the plenum. The principle of operation is that excessive leakage will result in a reduction of pressure in the plenum, which can then be compensated by increasing the applied pressure to the systems of seals.

Though capable of opposing leakage and preventing large leaks, such a system may lead to excess fabric wear, particularly in wide machines, because sealing is generally performed across the entire width of the machine, rather than solely in the locations where leak reduction is needed. Further, use of internal pressure measurements to detect leak control may lead to some false readings of leakage when pressure fluctuates for other reasons, such as changes in web properties or compressor operation or air temperature. Further still, a single macroscopic measure of pressure cannot be used to locate specific leaks, only leakage in general. Therefore, what is lacking and needed is a method and apparatus for detecting the specific location of leaks and applying corrective remedies to prevent leakage only at the locations where leakage is occurring.

SUMMARY OF THE INVENTION

Pressurized or depressurized web treatment chambers for processing moving webs can operate more efficiently if fluid leaks are detected and controlled with localized leak detection means and with localized leak reduction means, wherein the leak reduction means is operatively responsive to the leak detection means such that local leaks are effectively sealed or reduced in severity.

In particular, a control method has been discovered for web treatment systems for moving webs, the treatment system involving at least one chamber at a pressure substantially different from the ambient pressure, wherein localized leaks are detected by one or more leak detectors and wherein the leaks are reduced by application of pressure reduction means responsive to the one or more leak detectors. The control method of the present invention can provide improved means for prevention of leaks in web treatment systems of all kinds wherein a moving web passes through a pressurized treatment chamber.

Further, the control system of the present invention can be used to prevent leakage of chemicals from a web treatment chamber or to prevent excess infusion of atmospheric air or oxygen into web treatment chamber by means of localized leak or infusion detectors operatively associated with localized leak reduction means to apply improved sealing in the localized regions where such action is needed. Such a system is desirable when the fluid in the web treatment chamber has a substantially different chemical composition than the ambient atmosphere and it is desired to prevent leakage of the treatment fluid into the atmosphere or to prevent leakage of air into the chamber. Again, it is desirable to maintain effective seals across substantial distances as a web passes through the seals through a combination of localized leak detection and reduction, rather than subjecting the entire apparatus or entire extent of the web and the seals to increased clamping pressures. As used herein, the term "leak" encompasses both the escape of fluid from within the chamber (e.g., the escape of pressurized air from an air press) and the infusion of fluid into the chamber (e.g., infusion of the atmosphere into a low pressure treatment chamber).

Cross-directional flexible seals with leakage control according to the present invention are desirable for the entrances and exits to enclosed pressurized web treatment chambers, such as steam heating chambers, while machine-direction edge seals and a corresponding control system are desirable for other web treatment devices.

Hence, in one aspect, the present invention resides in a control system for detecting and reducing fluid leaks along a seal between a moving web and a web treatment chamber, wherein the web treatment chamber applies a fluid at a pressure other than the ambient pressure to a surface of the moving web, the control system comprising:

a) a leak detector for indicating the presence and location of a fluid leak between the moving web and the seal; and b) localized leak reduction means responsive to the localized leak detector means.

In another aspect, the invention resides in a method for reducing leaks in a pressurized web treatment system for treating a moving web with a pressurized fluid, the web treatment system comprising a pressurized chamber, and a seal between the web and the chamber, comprising:

a) detecting a leak along the seal, the leak having an estimated severity above a predetermined minimum value, b) identifying the approximate location of the leak;

c) generating a signal indicative of the approximate location of the leak; and d) increasing local sealing pressure above a predetermined minimum along the seal in the approximate location of the leak responsive to the signal, such that leakage is reduced.

The above method can further comprise the step of incrementally reducing the local sealing pressure in the region where sealing pressure was increased until leakage in said region begins to increase, then increasing the sealing pressure again slightly to a level before increased leakage was detected, whereby excessive sealing pressures are avoided when not needed to reduce leakage.

In another aspect, the invention resides in a pressurized web treatment system for applying a pressurized fluid from a fluid source to a moving web while dynamically reducing fluid leaks to the atmosphere, comprising:

a) a web treatment chamber comprising chamber walls that define an interior plenum, a fluid inlet for receiving pressurized fluid from a fluid source, an opening for applying pressurized fluid to a moving web, a leading edge and a trailing edge both extending in the cross direction, opposing side edges extending in the machine direction, and a flexible seal assembly along at least one of the leading edge, the trailing edge, and the side edges, for preventing leakage of the pressurized fluid, the seal assembly comprising a first seal head in contact with the web treatment chamber and an opposing second seal head such that the web passes between the first and second seal heads and wherein one of the first and second seal heads is urged toward the other of the first and second seal heads with a sealing force; and b) a control system for reducing fluid leaks along the seal assembly comprising a leak detector for identifying the presence and location of a fluid leak between the moving web and the seal assembly, and localized leak reduction means responsive to the leak detector, wherein the localized leak reduction means comprises a force generator for variably adjusting the sealing pressure along the length of the seal assembly to reduce leakage in the vicinity of the fluid leak as identified by the leak detector.

In yet another aspect, the invention resides in a treatment system for a moving web with improved leakage control, the web having a first surface and a second surface, comprising:

a) a chamber comprising a plenum for pressurized fluid in fluid communication with the web, the chamber having at least one edge along which the web travels into or out of the chamber;

b) a flexible seal assembly in contact with said at least one edge for preventing leakage of pressurized fluid from the treatment system;

c) a leak detector responsive to fluid leaks along the seal such that the approximate location of fluid leaks can be identified; and d) localized leak reduction means along the seal assembly cooperatively associated with the leak detector such that increased sealing force is applied where leaks occur.

In yet another aspect, the invention resides in an air press for dewatering a moving web having improved CD control of leakage, comprising:

a) an air press having at a pressurized gas chamber and least one CD seal element;

b) a localized leak detector external to the pressurized gas chamber; and c) a localized force generator to increase the pressure on the seal, the force generator being cooperatively associated with the leak detector.

Chambers that treat moving webs at pressure other than ambient pressure and particularly at elevated pressure can be generally described, in the context of the present invention, as stationary or non-rotary plenums having a gas inlet to provide a treatment gas or vapor which can contact the web. Contact of the gas with the web is typically by means of the gas flowing through an opening or multiple openings in a treatment face of the chamber that conducts fluid from the plenum to the moving web. The treatment face may be substantially flat or curved. Desirably, it is non-rotary (i.e., it does not rotate continuously during use as does a rotating roll) and substantially static or stationary. Desirably, the web passes through the treatment chamber in a substantially flat form and particularly with a radius of curvature of greater than 30 inches and more particularly with a radius of curvature of greater than about 60 inches.

In many embodiments, the treatment gas in intended to at least partially pass through the thickness of the web, though for steam heating and treatment with reactive chemicals it is not necessary for the gas or vapor to fully pass through the web. When the leakage through open gaps at the entrance, exit, or sides is unacceptable, sealing at any line or region of potential leakage can be provided by placing upper and lower seal elements respectively above and beneath the moving web.

The seal elements are desirably movable or flexible such that they can be brought into contact with the web or with the fabric, wire, or belt on which the web may reside. For example, for treatment of strong movable webs such as a moving textile web, there may be no need for a supporting wire or fabric and the seals may directly contact the moving web. In other cases, the web may require the support a fabric, wire, or belt, such that one seal element contacts the supporting fabric, wire, or belt, while the other opposing seal element contacts the moving web directly. For weaker or more easily damaged materials such as a moist paper web, direct contact with a seal element, particularly a stationary seal element, could result in damage to the web. Thus, it is desirable that certain weak webs such as moist paper webs be sandwiched between two moving fabrics, wires, or belts, to protect the web from direct contact with seal elements. In any case, the combination of the web and any adjacent fabrics, belts, or wires passes through opposing upper and lower seal elements that extend across the leakage zone (e.g., across the cross-direction width of the web for a CD seal element or along the length of the treatment chamber for an MD seal element) and that prevent excess leakage from the pressurized treatment chamber.

For the purposes of the present invention, at least one of the opposing seal elements along a sealing zone is locally deformable, flexible, or locally movable, such that the seal element can respond to an increase in a localized driving force to preferentially adjust the gap between the opposing seal elements in the region of the locally applied force. Similarly, the seal element can respond to the urging or biasing of an actuator or to a change in the position of an actuator or position element attached to or in contact with the seal element to preferentially move the seal element toward and/or away from the web only in the region of the leak. Thus, the sealing means for a treatment chamber comprise a deformable, flexible, or locally movable seal element responsive to locally adjustable force generators or position controllers or means therefor.

Deformable seal elements comprise those of the previously referenced Hada et al. patent application. Seal elements can be a single strip or beam of flexible material such as rubber, Teflon (duPont de Nemours & Co. Inc., Wilmington, Del.) and related fluoropolymers, polyethylene or polypropylene, or the like, or thin metallic beams, rods, or shells capable of suitably flexible deformation under application of force to serve as a sealing element. In one embodiment, the seal element comprises a series of slidable sections joined together but capable or independent or substantial independent deformation or positioning in the sealing direction (i.e., the direction normal to the axis of the seal zone and substantially normal to the moving web in the area being sealed). For example, slidable seal sections can be discrete sections that are interlocked mechanically, for example by a dovetail geometric shape the prevents adjacent sections from separating but permits relative motion in the sealing direction. Slidable elements also can be individually mounted on rods or bearing elements to prevent lateral motion while permitting motion in the sealing direction. Useful support elements for a deformable seal element include interlocked, slidably movable units driven by local actuators or pistons; flexible solid or hollow beams; or the like.

Useful means for applying local sealing force include those systems for adjusting flexible elements known in the art of crepe blade control in tissue making, in the art of slice lip control for headboxes in papermaking, and in the art of press nip control in elongated nips or extended nips known in the art of wet pressing for papermaking. As is known in these and other arts, a wide variety of force generators can be used to drive, bend, flex, move, or reposition a beam, a portion of a beam, or a slidable section in a beam. The beam supporting or holding the seal elements should be deformable or locally movable to permit a force generation means to adjust the shape or position of the beam locally to enable improved local sealing upon application of appropriate force. The deformation or profile of the seal element is determined by the profile of force applied to it or by the action of position adjustment means that determine the position or displacement of structural elements in contact with the seal element.

Locally adjustable force generators or seal element positioners are used to locally control the sealing effect of the seal element to eliminate leakage where needed. A force generator or a seal element positioner such as a position actuator is locally adjustable if there are multiple regions extending across the zone being sealed where the applied force or position of a member can be adjusted to provide a degree of profiling. There are suitably at least two separately adjustable force generators or seal element positioners, but desirably there are at least three and specifically at least five, more specifically at least 8, and more specifically at least 10 separately adjustable force generators or seal element positioning means.

Examples of force generation means suitable for applying variable local force to a seal element include thermal expanding rods, thermal expanding beam elements, thermal hydraulic actuators, mechanical actuators, electric motors, piezoelectric elements, single chamber or multiple chambered air bags, gas cylinders, pneumatic pistons, hydraulic pistons, thermoelectric actuators, mechanical screws, gear assemblies, pulley assemblies, lever and fulcrum assemblies, screw and jack assemblies, adjustable spring assemblies, magnetic force generation systems, or the like. Motors can also be used, such as electric or combustion-driven motors adapted for applying torque or force, particularly when the motor is only required to run momentarily to jog an element into a suitable position, wherein the element can be locked into place by a ratchet and pawl or other means. An example of force generation means coupled to a deformable element is the hydraulically loaded shoe in a typical extended nip or elongated nip press, such as that disclosed by Holopainen in U.S. Pat. No. 5,620,566, issued Apr. 15, 1997, incorporated herein by reference. Holopainen teaches a cross-direction support shoe cooperating with a circular shell serving as a press roll. The support shoe is movably connected to a seat, and between the seat and support shoe are a series of sealed chambers that can receive pressurized fluid. By varying the pressure in each of the chambers, the force applied to the support shoe can be locally varied. The support shoe can be a deformable material to respond more fully to the force profile provided by the variable pressure in the sealed chambers, thus providing a degree of pressure profiling applied to a press nip. More generally, for the present invention, a seat can cooperate with a deformable head via variable pressure or force generation means therebetween to provide a pressure profile to the deformable head, the head being either attached to or cooperating with a seal element. In this case, the portion of the seal element contacting the web or wire may be rigid or deformable, for it is the underlying movable head that is deformable to achieve profiling.

Seal element positioning means can comprise all the previously mentioned force means adapted to move one body relative to another by overcoming a force. Other means for adjusting the position of one body relative to another may be used, including electromotive systems, magnetic levitation, rack and pinion systems, and the use of positioning elements slidably mounted on bearings or rods that can be moved into a desired position.

The deformable or movable seal elements are deformed or moved locally upon application of appropriate force in response to a signal or information provided by local leak detection means. Thus, if local leak detection means indicate that excess gas leakage is occurring in the central portion of a seal, local sealing force in the central portion of the seal would be increased to reduce leakage in that region.

Without wishing to be limited by specific examples, illustrative leak detectors suitable for the present invention include but are not limited to the following:

1. Acoustic sensors such as microphones to detect the presence of leaks based on the sound emitted. An array of microphones or transducers, either sonic, ultrasonic, or subsonic, can be mounted on the plenum, adjacent the plenum, remote from the plenum, or in acoustic communication with the plenum, such that the sensors respond to sound waves created by the dynamics of the leaking stream. In many cases, acoustic sensors covering a frequency of about 1000 Hz to 15,000 Hz will be suitable. Since important information about the size and intensity of the leak can be extracted from the combination of sound intensity and its frequency range or power spectrum, it is desired in some applications that both frequency and intensity information be obtained.

2. Vibration detection systems such as piezoelectric devices or accelerometers responsive to localized motion of solid surfaces on or adjacent to the treatment chamber that can give non-baseline readings in the presence of leaks. Laser-based Doppler anemometers, speckle interferometers, or the like can also be used to assess vibration of a surface.

3. Thermal flow detection means based on the increased heat transfer that occurs in higher velocity flow or based on a temperature difference between the ambient fluid and the pressurized or depressurized fluid in the plenum. In the presence of increased velocity flow, the increased heat transfer coefficient can be sensed with heat flux detectors or hot wire anemometers. Psychrometers, wet bulb thermometers, wetted surfaces, and other devices can indicate the presence of increased velocity gas flow due to the improved evaporative transport or cooling that occurs. When fluid at an elevated or depressed temperature relative to the ambient atmosphere escapes from the plenum, it will result in flows having different temperatures which can be measured by thermometers, thermocouples, thermistors, infrared detectors, liquid crystal thermal displays, other known temperature sensors, thermography with IR-sensitive cameras, or the like. Likewise, if leakage from the atmosphere into a depressurized plenum occurs, the increased heat transfer caused by the in-rushing air or the local temperature changes caused by the atmosphere can be detected with temperature or heat flux measurement means, preferably mounted inside the plenum near the region of potential leakage or mounted on or in the seal elements. Thermal flow detection means can also be responsive to the temperature change that can occur as a pressurized gas passes through a narrow orifice, such as the Joule-Thompson effect.

4. Optical sensors that respond to the gap thickness between opposing seal surfaces to detect changes in light transmission through the edges of the pressurized plenum, particularly in conjunction with suitable light sources. For example, a CCD strip inside a plenum could respond to light from a bright line of lights or a fluorescent tube outside the plenum with suitable light guides and optics to identify the location of the light leak.

5. Chemical sensors, particularly gas sensors for a particular chemical species, that respond to a major or trace component in the treatment gas which may leak into the ambient atmosphere and be detected, or that respond to oxygen or other components of air when entry of the atmosphere into a treatment chamber is to be detected.

6. Gap size measuring devices to directly measure the gap between two opposing seal surfaces or between a seal and a web or fabric, wherein gap size is maintained to a preset value or adjusted in response to leakage detection. Eddy current sensors can also be used to measure the distance between metal components inside two opposing sealing surfaces to assist in regulating and controlling gap thickness at the seals. Gap size can be correlated to leakage or leakage tendency.

7. Mechanical indicators of local flow such as a series of vanes or other rotating devices capable of moving in response to the presence of a local leak, or strips of flexible material such as strings or cloth secured at at least one end and unsecured over a portion of the length of the article such that waving or flapping is possible in response to a leak, to provide a visual cue that leakage is occurring. Flaps, ribbons, and other materials movable in response to air flow can be used.

8. Gas flow or velocity measurement devices such as laser anemometry, hot film or hot wire anemometers, other optical velocimeters, small turbine or vane anemometers, or other such devices to measure the presence of leaks directly in the location of a potential leak zone. In the case of laser Doppler anemometry, the optics could be scanned to move the focal point or measurement volume of the device along a finite zone where leakage may occur. Alternatively, the entire anemometer could be physically scanned, or multiple lasers and optical systems could be used to examine multiple regions.

9. Flow visualization means can be applied to make a local leak visible. For example, a film of surfactant-treated liquid applied near leakage zones could result in a bubble or a visible stream of bubbles near the leak. Likewise, dust, particulates, entrained droplets, aerosols, or other non-gaseous material near the zone of leakage or periodically applied near the zone of potential leakage can provide a visual cue of leakage due to the plumes or visible flow streams created by entrainment or disruption of the materials. The escaping fluid itself may be visible as it escapes from the plenum or may be made visible by means of adding, if only at discrete intervals in time, an amount of a particulate or condensable stream such as steam or an aerosol such as fog or oil droplets or an entrained solid phase such as $TiO_2$ or dust. The visible or visualizable escaping (or, for depressurized system, in-rushing) flow can be detected in any way known in the art, such as by image analysis of CCD camera images. The visible stream can also be sensed optically by the changed intensity of a light beam passing across the potential leakage zone as sensed by a photodetector or optical eye.

For detection of leaks from a pressurized chamber, leak detector sensors or systems will generally be external to the pressurized plenum (though some optical and flow-based detection means may require or be successful with internal probes or sensing devices mounted inside the plenum). For detection of leaks of air or other gases into a depressurized plenum, leak detection sensors can typically be mounted inside the plenum, particularly for oxygen sensors detecting air entry into a chamber.

In a typical embodiment, a moving web is treated in a pressurized chamber. The web may be a web of textile; a woven or nonwoven fabric; a web of papermaking fibers; a polymeric film such as an apertured film; a film undergoing aperturing; an impervious film being treated on one surface at elevated fluid pressure; a metallic foil or sheet; a mat of vegetable matter; a thin wood composite; or the like.

In one application, the moving web comprises activated carbon fibers or a precursor for preparation of activated carbon fabrics. Particularly, the web can be a mat of woven or nonwoven fiberglass or other temperature-resistant inert web impregnated with a phenolic resin preferably further comprising a crosslinking agent such that the resin can be charred while on the inert web to form a carbonaceous coating on the inert web. The charred web can then be treated in a heated gas treatment chamber to activate the carbon and provide desired surface chemistry. Gases such as hydrochloric acid, ammonia, ozone, and other compounds can be used. Acidic groups can be added to the surface of the activated carbon by treating the fibers at elevated temperature in the presence of steam, carbon dioxide, nitric acid, or the like. Basic groups, useful for absorbing acidic compounds such as HCl, can be introduced by treatment with ammonia at elevated temperatures or by other treatments known in the art. Suitable fibers and fiber treatment methods include those disclosed in PCT patent application, "Coated Absorbent Fibers," by James Economy and Michael Daley of the University of Illinois, published as WO 96/38232, Dec. 5, 1996, and on the Univ. of Illinois Web site at "http://www.students.uiuc.edu/~ahall/activated carbon fabrics.html" as of Jun. 1, 1998, which discloses a variety of gas treatments at elevated temperature to activate the fibers and control the surface chemistry. The gases should be at a pressure above atmospheric pressure to resist entry of air and should pass completely through the charred web to treat the carbon. Seals are needed for the web as it enters and leaves the heated gas treatment chamber to prevent excess consumption of treatment gas and to prevent oxygen entry. The seals and control system of the present invention can be used for treatment of such webs for the production of activated carbon fabrics. Such activated carbon fabrics are useful for odor control and particularly for incorporation into an absorbent article, for filtration of gases, for use as face masks for medical purposes, for absorption of chemical warfare agents, or the like.

The seal control system of the present invention can also be used in steam boxes for heating and drying of paper webs and textiles, for displacement dewatering of wet webs wherein gas displaces liquid water, for pressurized units in which heated gas is used to create apertures in polymeric films for subsequent use as cover materials in absorbent articles, for particle entrainment in nonwoven and woven webs, for ozonation of textile, paper, and other webs, including disinfectant treatments; or the like.

The control method of the present invention can provide improved means for prevention of leaks in web treatment systems of all kinds wherein a moving web passes through a pressurized treatment chamber. For example, the leakage control system of the present invention is not only suitable for pressurized treatment chambers in which gas passes through a web, but for pressurized treatment chambers where gas at elevated pressure is used to react with or heat a web, particularly for drying. Several examples of a steam treatment chamber for drying a web are found in "Condebelt" drying systems, wherein a paper web is heated on one side by a metal band and the web is cooled on the other side, as disclosed in the following patents: U.S. Pat. No. 5,594,997 issued Jan. 21, 1997 to Lehtinen; U.S. Pat. No. 4,899,461 issued Feb. 13, 1990 to Lehtinen; U.S. Pat. No. 5,594,996 issued Jan. 21, 1997 to Haavisto; and U.S. Pat. No. 4,958,444 issued Sep. 25, 1990 to Rautakorpi et al.; all of which are incorporated herein by reference. Cross-directional flexible seals with leakage control according to the present invention are desirable for the entrances and exits to pressurized web treatment chambers, such as the steam-heated chambers of Haavisto, while machine-direction edge seals and a corresponding control system are desirable for the apparatus disclosed by Lehtinen.

The disclosed control system may also be used with single CD seal elements, meaning that the treatment chamber only has one side with a CD seal. The need for a single seal can arise in a variety of cases where a roll of a web such as a textile resides in a pressurized chamber from which the web is unwound and withdrawn without completely relieving the pressure in the chamber. The objective, then, is to maintain a CD seal to reduce pressure loss from the chamber. The need for only one CD seal can arise when a web is formed or created under pressurized conditions and is removed from a reaction chamber without the need for a corresponding seal on the web going into the chamber because the web as such does not go into the chamber but is formed therein.

Alternatively, some pressurized treatments may have two CD seals but only one seal requires improved sealing or CD seal control. Likewise, a treatment may have more than two CD seal sections having CD control.

The principles of the present invention extend not only to CD leak control but also to MD leak control. Specifically, the seal extending along the side edges of a pressurized web treatment device may also be subject to leakage in particular locations and may also benefit from localized leakage detection and control. Certainly CD seals tend to have greater length than MD seals in many web handling situations because there is a trend to make machines increasingly wider. Nevertheless, the finite extent of MD seals in web treatment devices also gives rise to nonuniform leakage spots and makes it advantageous to provide selective local adjustment of sealing force on or the position of seal elements to prevent leakage without excessive wear of seal components, fabrics, or other elements due to unnecessary clamping or excessively high force or friction.

The MD seals can be flexible lips that engage any support fabrics for the moving web along the extreme sides of the fabrics, with air hoses, air bags, solenoids, hydraulic cylinders, pneumatic cylinders, screws, and other known force generating means being used to provide the possibility of profiling in sealing force along the extent of the MD seal. As with CD seals, leakage detection means can identify the location of leaks and send a signal to the force generating means to adjust the sealing pressure in the region of the leakage. The air press system of Hada et al. in U.S. application Ser. No. 08/961,915, filed Oct. 31, 1997 provides examples of MD seals as well as CD seals.

One aspect of the present invention concerns an air press for noncompressively dewatering the wet web. The air press is disclosed in the commonly owned copending application of Hada et al., previously incorporated by reference. The air press is a particularly desirable apparatus for dewatering an uncreped throughdried web to about 30 percent consistency or greater prior to a differential speed transfer. While pressurized fluid jets in combination with a vacuum device have previously been discussed in the patent literature, such devices have not been widely used in tissue manufacturing. A disincentive to using such equipment is believed to be due to the difficulties of actual implementation, including pressurized fluid leaks. The air press of Hada et al. overcomes many prior objections to such a process, and coupled now with the leakage control system of the present invention, offers significant improvements in the ability to dewater a sheet effectively either prior to through drying or as an enhancement of tissue production with a Yankee dryer. In the latter case, improved tissue dried by a Yankee dryer can be made by imparting texture and bulk to the web with sculpted or contoured fabrics such as the sculpted TAD fabrics of Chiu et al. in U.S. Pat. No. 5,429,686, issued Jul. 4, 1995 and incorporated herein by reference, but the texturized tissue web will have less contact with the Yankee unless pressed so hard as to lose the benefits of the texture imparted by the fabric. Less contact with the Yankee reduces drying rates, so additional drying is needed prior to the Yankee for effective sheet molding and structuring. The air press provides a practical apparatus for dewatering a wet web to consistency levels not previously thought possible at industrially useful speeds without thermal dewatering.

In one embodiment, an air press for dewatering a wet web comprises: support fabrics adapted to sandwich the wet web therebetween and transport the wet web through the air press; a first dewatering device comprising a pair of cross-machine direction sealing members including sealing blades; a second dewatering device comprising a cross-machine direction sealing member formed of a deformable material, the first and second dewatering devices moveable relative to one another and adapted to assume an operating position in which the first and second dewatering devices are operatively associated with one another and at least one sealing blade impinges upon the support fabrics and is opposed on the other side of the support fabrics by the sealing member formed of deformable material; and wherein one of the first and second dewatering devices comprises an air plenum operatively connected to a source of pressurized fluid and the other comprises a collection device operatively connected to a vacuum source.

In another embodiment, an air press for dewatering a wet web according to the present invention comprises: support fabrics adapted to sandwich the wet web therebetween and transport the wet web through the air press; an air plenum positioned on one side of the wet web and operatively connected to a source of pressurized fluid, the air plenum comprising a profitable or segmented sealing assembly that is adapted to move at each segment or section between an operating position and a retracted position, the sealing assembly comprising a pair of machine direction sealing members and a pair of cross-machine direction sealing members that form an integral seal with the wet web when the sealing assembly is in the operating position; a collection device positioned on the opposite side of the wet web and operatively associated with the air plenum, the collection device defining therein sealing slots that extend across the width of the wet web and also defining therein a central passageway disposed between the sealing slots and adapted to receive pressurized fluid from the air plenum and water from the wet web, and means for moving the machine direction sealing members into and out of contact with one of the support fabrics, the machine direction sealing members forming a seal when the sealing assembly is in the operating position.

The air press is able to dewater the wet web to very high consistencies due in large part to the high pressure differential established across the web and the resulting air flow through the web. In particular embodiments, for example, the air press can increase the consistency of the wet web by about 3 percent or greater, particularly about 5 percent or greater, such as from about 5 to about 20 percent, more particularly about 7 percent or greater, and more particularly still about 7 percent or greater, such as from about 7 to 20 percent. Thus, the consistency of the wet web upon exiting the air press may be about 25 percent or greater, about 26 percent or greater, about 27 percent or greater, about 28 percent or greater, about 29 percent or greater, and is desirably about 30 percent or greater, particularly about 31 percent or greater, more particularly about 32 percent or greater, such as from about 32 to about 42 percent, more particularly about 33 percent or greater, even more particularly about 34 percent or greater, such as from about 34 to about 42 percent, and still more particularly about 35 percent or greater.

The air press is able to achieve these consistency levels while the machine is operating at industrially useful speeds. As used herein, "high-speed operation" or "industrially useful speed" for a tissue machine refers to a machine speed at least as great as any one of the following values or ranges, in feet per minute: 1,000; 1,500; 2,000; 2,500; 3,000; 3,500; 4,000; 4,500; 5,000, 5,500; 6,000; 6,500; 7,000; 8,000; 9,000; 10,000, and a range having an upper and a lower limit of any of the above listed values. Optional steam showers or the like may be employed before the air press to increase the post air press consistency and/or to modify the cross-machine direction moisture profile of the web. Furthermore, higher consistencies may be achieved when machine speeds are relatively low and the dwell time in the air press in higher.

The pressure differential across the wet web provided by the air press may be about 25 inches of mercury or greater, such as from about 25 to about 120 inches of mercury, particularly about 35 inches of mercury or greater, such as from about 35 to about 60 inches of mercury, and more particularly from about 40 to about 50 inches of mercury. This may be achieved in part by an air plenum of the air press maintaining a fluid pressure on one side of the wet web of greater than 0 to about 60 pounds per square inch gauge (psig), particularly greater than 0 to about 30 psig, more particularly about 5 psig or greater, such as about 5 to about 30 psig, and more particularly still from about 5 to about 20 psig. The collection device of the air press desirably functions as a vacuum box operating at 0 to about 29 inches of mercury vacuum, particularly 0 to about 25 inches of mercury vacuum, particularly greater than 0 to about 25 inches of mercury vacuum, and more particularly from about 10 to about 20 inches of mercury vacuum, such as about 15 inches of mercury vacuum. Both pressure levels within both the air plenum and the collection device are desirably monitored and controlled to predetermined levels.

The collection device desirably but not necessarily forms an integral seal with the air plenum and draws a vacuum to facilitate its function as a collection device for air and liquid. The terms "integral seal" and "integrally sealed" are used herein to refer to: the relationship between the air plenum and the wet web where the air plenum is operatively associated and in indirect contact with the web such that about 70 percent or greater of the air fed to the air plenum flows through the web when the air plenum is operated at a pressure differential across the web of about 30 inches of mercury or greater; and the relationship between the air plenum and the collection device where the air plenum is operatively associated and in indirect contact with the web and the collection device such that about 70 percent or greater of the air fed to the air plenum flows through the web into the collection device when the air plenum and collection device are operated at a pressure differential across the web of about 30 inches of mercury or greater.

Significantly, the pressurized fluid used in the air press is sealed from ambient air to create a substantial air flow through the web, which results in the tremendous dewatering capability of the air press. The flow of pressurized fluid through the air press is suitably from about 5 to about 500 standard cubic feet per minute (SCFM) per square inch of open area, particularly about 10 SCFM per square inch of open area or greater, such as from about 10 to about 200 SCFM per square inch of open area, and more particularly about 40 SCFM per square inch of open area or greater, such as from about 40 to about 120 SCFM per square inch of open area. Desirably, 70 percent or greater, particularly 80 percent or greater, and more particularly 90 percent or greater, of the pressurized fluid supplied to the air plenum is drawn through the wet web into the vacuum box. For purposes of the present invention, the term "standard cubic feet per minute" means cubic feet per minute measured at 14.7 pounds per square inch absolute and 60 degrees Fahrenheit (° F.).

The terms "air" and "pressurized fluid" are used interchangeably herein to refer to any gaseous substance used in the air press to dewater the web. The gaseous substance suitably comprises air, steam or the like. Desirably, the pressurized fluid comprises air at ambient temperature, or air heated only by the process of pressurization to a temperature of about 300° F. or less, more particularly about 150° F. or less.

In an alternative embodiment, a device for dewatering a wet web traveling in a machine direction, comprises: a frame structure; support fabrics adapted to sandwich the wet web therebetween; an air press comprising an air plenum and a collection device positioned on opposite sides of the wet web and support fabrics, the air plenum and collection device operatively associated with one another and adapted to establish a flow of pressurized fluid through the wet web, the air plenum comprising: stationary components mounted on the frame structure; a profitable sealing assembly that is adapted to move relative to the stationary components between an operating position and a retracted position with variation in position of segments or sections along the sealing assembly providing a degree of independent control over each segment or section. The sealing assembly comprises a pair of optionally profitable machine direction sealing members and a pair of profitable cross-machine direction sealing members that together form an integral seal with the wet web when the sealing assembly is in the operating position; means for moving the cross-machine direction sealing members generally perpendicular to a plane containing the wet web and into and out of contact with one of the support fabrics; means for moving the machine direction sealing members generally perpendicular to the plane containing the wet web and into and out of contact with one of the support fabrics; and means for moving the machine direction sealing members generally parallel to the plane containing the wet web and generally perpendicular to the machine direction.

In another alternative embodiment, a device for dewatering a wet web traveling in a machine direction, comprises: a frame structure; support fabrics adapted to sandwich the wet web therebetween; an air press comprising an air plenum and a collection device positioned on opposite sides of the wet web and support fabrics, the air plenum and collection device operatively associated with one another and adapted to establish a flow of pressurized fluid through the wet web, the air plenum comprising: stationary components mounted on the frame structure and defining a loading surface generally parallel to a plane containing the wet web; a sealing assembly that is adapted to move relative to the stationary components between an operating position in which the sealing assembly forms an integral seal with the wet web and a retracted position, the sealing assembly defining a control surface generally parallel to the plane containing the wet web and adapted to contact the loading surface; and means for moving the sealing assembly generally perpendicular to the plane containing the wet web, wherein contact between the control surface and the loading surface interrupts movement of the sealing assembly toward the wet web when the sealing assembly reaches the operating position.

The air press may use internal surfaces that are normal to the loading direction to completely isolate the loading force from the air plenum pressure. Thus, the loading force can be maintained at a constant value to provide a proper seal despite the air plenum pressure varying from zero to maximum pressure. Accordingly, the loading force does not have to be adjusted in response to pressure changes within the air press.

Definition of Terms and Test Procedures

As used herein, "fluid" refers to non-solid matter, specifically liquids or gases. Though gas is most commonly used in pressurized web treatment chambers, liquids can also be applied. Liquids that could be used according to the present invention include water, resins to make impregnated paper, dyes, surface chemistry modifying solutions, supercritical fluids (classifiable as either a liquid or a gas), solvents for removing undesired components, or the like.

As used herein, "gas" refers to a chemical composition which is not in a liquid or solid state, but is gaseous. Exemplary gases of use in the present invention include air, steam, nitrogen, oxygen, ozone, chlorine, bromine, and other halogens, acid vapors such as HCI or sulfuric acid fumes, ammonia and nitrogenated compounds, chlorinated species such as bleaching agents or dry cleaning compounds, solvent vapors, formaldeyde and other crosslinking agents, alcohols, or the like, either as pure components or in mixtures.

As used herein, "vapor" refers to a readily condensable gas or the gases resulting from evaporation or boiling of a substance, with examples including steam, aliphatic fumes, many acid fumes, fumes of many heavy metal organic compounds in the gaseous state, particularly titanium and osmium compounds, sublimed material, or the like. The gases or vapors used to treat webs may also carry entrained or suspended liquid or solid materials such as superabsorbent particles; pH modifying agents or buffer compounds, activated carbon particles or fibers; synthetic or natural polymeric fibers or particulates; oils and emollients; dust; fume particles; baking powder; skin wellness agents such as zinc oxide or dimethicone; surfactants; bleaching agents; colors, dyes, and pigments; inorganic fillers such as calcium carbonate, titanium dioxide, chalk, talcum; or the like.

As used herein, "cross direction" (CD) refers to the direction substantially normal to the machine direction (the direction of movement) of a moving web. A seal element is said to run substantially in the cross-direction of the web if it extends across a greater distance normal to the machine direction than it extends in the machine direction. Desirably, the CD seal extends substantially across all of the width of a web.

As used herein, "Local Sensitivity" is the percentage of the linear extent of a sealed region that is occupied on the average by a separately controllable force generator or position controlling device. For example, a spaced apart linear array of 5 independently adjustable pistons or pressurized hose segments along a cross-direction seal could apply CD force profiling across the sealing zone with a Local Sensitivity of 20%.

DETAILED DESCRIPTION OF THE DRAWINGS

Figure 1:
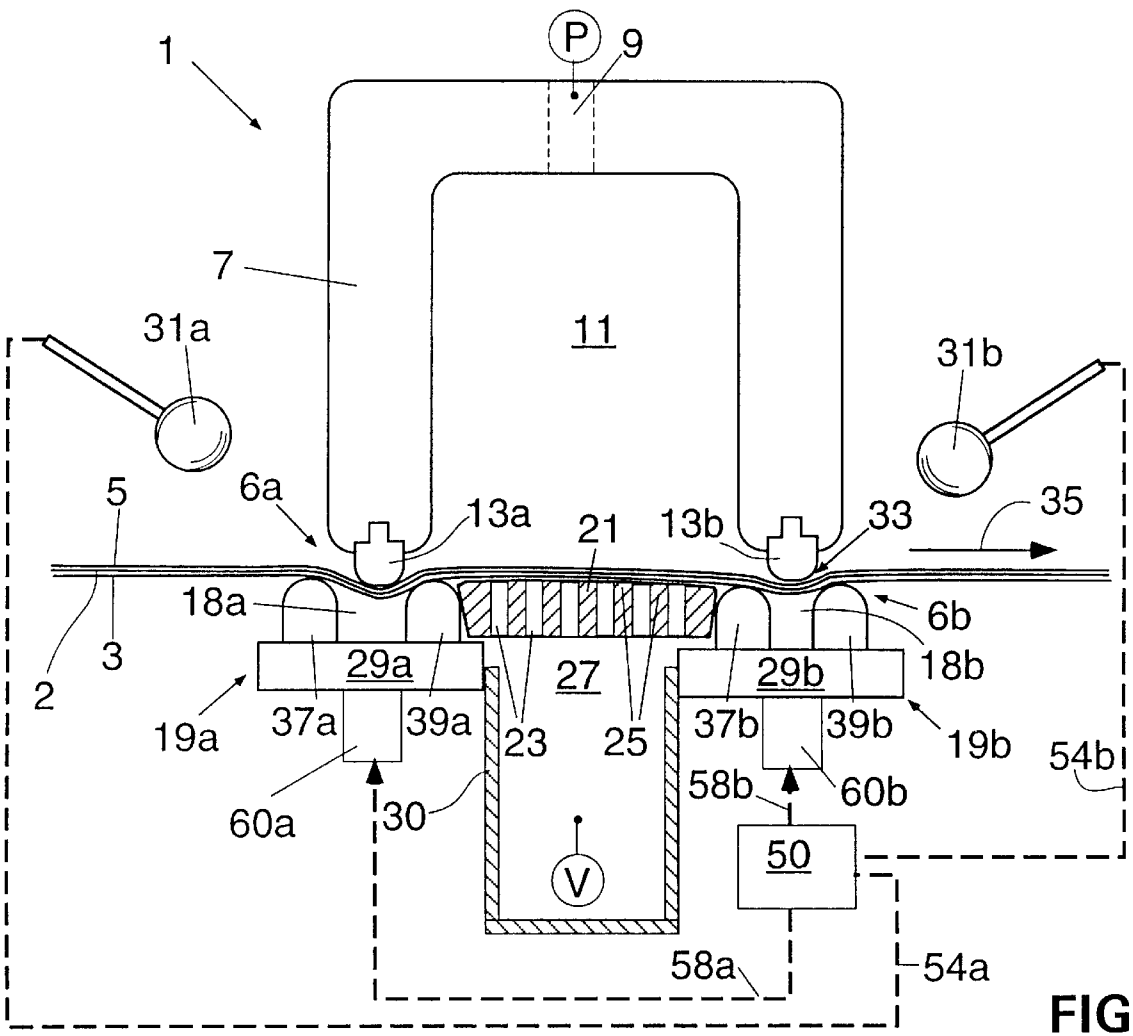
FIG. 1 is a schematic of the cross-section of an air press system showing a seal assembly and a microphone system for leak detection.

FIG. 1 shows one embodiment of an air press 1 for dewatering or otherwise treating a web 2 such as a paper web or other fibrous web. The web 2 can reside on a lower fabric 3 and can reside adjacent to an upper fabric 5. In the case of paper, it is desirable that the web 2 be sandwiched between both a lower fabric 3 and an upper fabric 5 moving at the same velocity as the web, which moves in the machine direction as indicated by the arrow 35 (from left to right in FIG. 1). The air press comprises an upper chamber 7 with a conduit 9 to a pressurized air or gas source P. The chamber walls define an upper plenum 11. The web 2 and any adjacent fabrics pass beneath the upper air press chamber 7 and over a support shoe 21 having support elements 25 and gas ports or vacuum slots 23 through which gas from the plenum can pass. Desirably, gas passing through the support shoe 21 passes into a lower plenum 27 in a vacuum box 30 from which it exits the air press assembly by means of a vacuum pump or other vacuum source V. Alternatively, the gas can be discharged through the shoe and into the atmosphere without reliance on a vacuum. The support elements 25 between the gas ports or vacuum slots 23 prevent excessive deflection of the web and any fabrics under the pressure differential that exists between the pressurized upper plenum 11 and the lower plenum 27.

To prevent excessive leakage along the cross-direction extent of the air press, leading and trailing edge seal assemblies 6*a* and 6*b* are provided at the leading and trailing edges of the air press, respectively. The leading edge seal assembly 6*a* can be similar to the trailing edge seal assembly 6*b*, as is the case in FIG. 1, or can employ other embodiments of the present invention. Turning attention to the trailing edge seal assembly 6*b* as a general example of one embodiment and as representative also of the leading edge seal assembly 6*a*, the seal assembly 6*b* comprises an upper seal head 13*b* which can deflect the web 2 and any adjacent fabrics 3, 5 into a recess 18*b* formed in a lower seal head 19*b*. The illustrated lower seal head 19*b* comprises first and second seal head members 37*b* and 39*b* which define therebetween the recess 18*b* and a support plate 29*b*, which can be a flexible or sectioned plate, a beam, a series of slidably movable segments, or other structures providing support and stability to the seal head 19*b*. Alternatively, the lower seal head 19*b* may comprise a deformable, flexible, and/or wearable portion with the web 2 being deflected toward or into this portion (not shown). Recess 18*b* is desirable, particularly for reducing friction, but is not essential, for the two lower seal head elements 37*b* and 39*b* can be replaced with a single lower seal head element in line with the upper seal head element 13*b* such that a sealing force can be directly transmitted between the opposing upper and lower seal head elements, at least one of which is deformable or movable such that a profile in the gap size between the opposing elements can be achieved and controlled along the length of the seal assembly 6*b*.

Support plate 29*b* can comprise either discrete zones in the cross-direction or a unitary structure that is flexible or deformable such that the positions of, or sealing force on, lower seal head 19*b* can be varied in the cross-direction by the local action of a force generation means or seal element positioning means 60*b* which cooperates with the base plate 29*b* and/or the seal head elements 37*b* and 39*b* to control the local sealing pressure or gap size along the length of the seal assembly 6*b*. Alternatively, the lower seal heads 37*b* and 39*b* are substantially fixed and the upper seal head 13*b* is movable normal to the web 2 via force generation means or position control means with cross-direction variability possible to permit control of the sealing force or relative sealing efficiency of the seal assembly 6*b* in the cross-direction.

When the relative positions of the upper seal head 13*b* and the lower seal head 19*b* are improperly adjusted, a gas leak can form through an escape route 33. This leak can be detected by leak detection means 31*b*, depicted in FIG. 1 as a microphone, representative of a bank of acoustic sensors whose signals can be analyzed to detect the proximity of the leak 33. The signal from the leak detection means 31*b* serves as input 54*b* to a controller 50 which can provide a signal 58*b* to force generation means or seal element positioning means 60*b*. Thus, elimination or reduction of the gas leak can be achieved by increasing the sealing force between the opposing seal heads 13*b* and 19*b* by force generation means 60*b*, or by adjusting their relative position by seal element positioning means 60*b* in the region of the escape route 33, as opposed to simply increasing the sealing pressure along the entire CD width of the seal assembly 6*b*.

Detection of the leak occurring through the escape route 33 can occur through a variety of leak detection means. FIG. 1 depicts a microphone 31*b*, which would be one of multiple microphones or acoustic sensors mounted near the air press's seal assembly 6*b* and spaced apart or distributed in the cross-direction. The sound made by the escaping gas passing through the escape route 33 can be detected by the microphone 31*b* and can also be analyzed for frequency and intensity information that can indicate the severity and nature of the leak. Based on analysis of the signal from the microphone by controller 50, the location of escape route 33 can be approximately identified. The controller 50 can comprise a microcomputer, an electronic circuit, or a manually operated system, to direct, guide, or control the action of the force generation means or seal element positioning means 60*b* to reduce the degree of leakage. Algorithms for computer control of the force generation means based on input from the leak detector 31*b* can readily be devised using techniques known in the art. The controller 50 directs force generation means or seal element positioning means to adjust the sealing force of the seal (or the relative position of the opposing seal heads) in the vicinity of the escape route 33 until the degree of leakage has been acceptably reduced. For example, a signal from the controller 50 can direct pneumatic devices associated with a segmented air hose to increase the air pressure in the segment associated with the region of leakage, or a signal from controller 50 can direct mechanical actuators to apply more or less force to particular segments of the seal assembly to control leakage. The controller 50 can be considered part of the leak detector 31*b* in terms of function but can have separate electronics or other components. Indeed, the electronics or other components needed for the simple task of interpreting the signal from the leak detector can physically reside within the body of the force generation means 60*b* or can be separate.

Secondary information about seal efficiency can also be extracted from pressure in the upper plenum 11, pressure in the lower plenum 27, gas mass flow rates out of the lower plenum 27 (as detected by a mass flow meter, for example), and by web properties associated with gas treatment (e.g., web moisture content and CD uniformity thereof when the air press is used to dewater a web). This information can be coupled to the controller 50 for validation or backup purposes, but information from the local leak detection means 31*b* provides critical input for selection of sealing or positioning strategies to reduce leakage and improve the efficiency and uniformity of treatment.

Desirably, the upper fabric 5, if used, has high permeability in the z-direction but has low in-plane permeability in the machine direction in order to prevent leakage through the fabric in the machine direction (or in the reverse machine direction). An example of a web with essentially no in-plane permeability would be a web made of laminated impervious layers provided with small isolated z-direction holes or apertures passing directly through the web, with hole diameters less than the contact length of the fabric against the upper seal head 13*b*. The fabrics 3 and 5 should be wear resistant and generally smooth to reduce friction.

Seal heads 13*b*, 37*b*, and 39*b* generally contact moving surfaces and may abrade. Therefore, it is desirable that they comprise abrasion resistant materials having low friction. Teflon and related fluoropolymers are known for low friction. Other synthetic polymers and ceramic materials known to offer good wear resistance and low friction can also be used, possibly with optional surface treatments such as plasma deposition of diamond or boron nitride for improved wear or lower friction. Silicon nitride is also known for excellent wear resistance, as are a variety of ceramic components and other materials now used in the art of papermaking for foils that contact moving fabrics. Other materials known in the art can be used, including metal such as steel with appropriate surface treatments such as carburization, ceramic deposition, plasma spray deposition of wear-resistant nitrides, or the like. Likewise, wear resistant fabrics are desirable to serve as web-contacting fabrics 3,5.

Desirably, the wearing surfaces of the seal heads 13*b*, 37*b*, and 39*b* are further provided with lubrication means and/or cooling means (not shown). A small quantity of water or other liquids suitable for the particular application may be applied to sealing head by spray or slot injection or other means just before the point of wire or fabric contact to reduce friction and also provide cooling.

Figure 2:
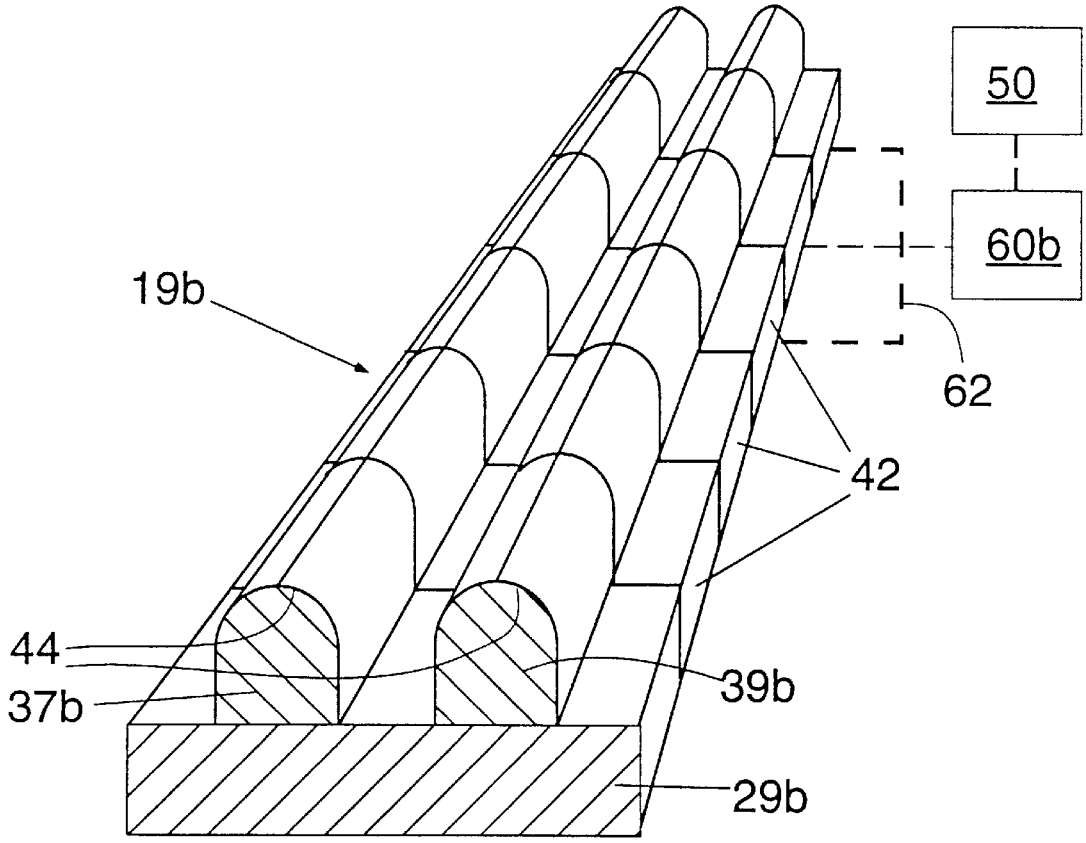
FIG. 2 shows one embodiment of a seal head used on one side of the web for a CD seal.

FIG. 2 shows the lower seal head 19*b* of the seal assembly 6*b* from FIG. 1, with a support plate 29*b* and seal head members 37*b* and 39*b*. The seal head members 37*b* and 39*b* have an outer surface with a contact region 44 for contacting a moving web, fabric, or belt. The seal head 19*b* permits variable CD control of applied force or of the position of the seal head members 37*b* and 39*b* at various zones in the cross-direction because the seal head 19*b* comprises individually movable segments 42 that are joined together but can move toward or away from the web to adjust the sealing efficiency in use. The segments 42 may be mounted on rods or other structures or may be geometrically connected as by a dovetail assembly to prevent separation in the cross-direction but to permit slidable movement normal to the cross-direction toward or away from the moving web. Force generation means or seal element positioning means 60*b* operatively connected to the individual segments 42, as indicated by lines 62 (which can represent direct or indirect contact by actuators, pneumatic devices, or other devices) can be used to adjust the position or applied force for each segment. Desirably, force generation means 60*b* act on the underside of the support plate 29*b*. The segments 42 of the support plate 29*b* can be rigid, and the seal head elements 37*b* and 39*b* can be deformable or rigid or have both rigid and deformable materials combined for effective sealing. Springs or similar deformable devices may be used to provide flexibility to segmented seal head elements 37*b* and 39*b*, which can comprise, for example, a rigid contacting strip supported by a spring element.

Figure 3:
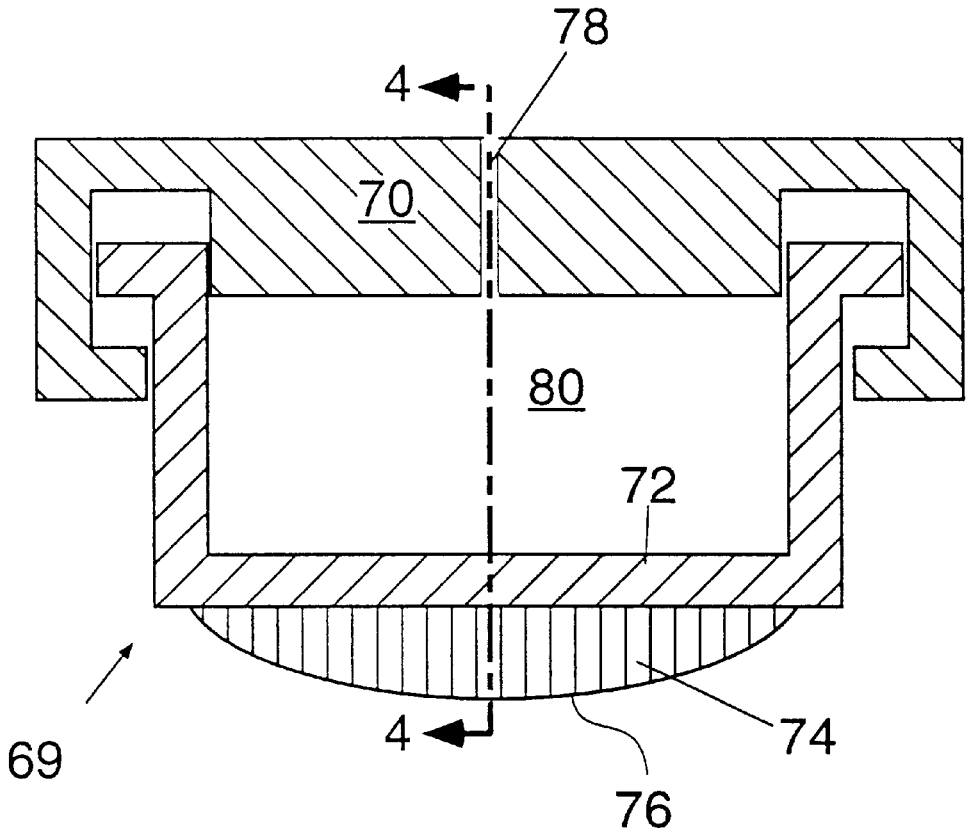
FIG. 3 shows a seal head and a support plate with pressurization means for controlling the force applied to the seal head.

FIG. 3 shows a cross-section of a seal head 69 which can serve as an upper or lower seal head, such as seal heads 13*b* or 19*b* of FIG. 1, or as seal head element 37*b* or 39*b* of FIG. 1, or as a single section 42 of a seal head 19*b* in FIG. 2, or as a general seal head in a seal assembly. The cross-section is taken perpendicular to the sealing axis. Seal head 69 comprises a sealing member 74 with a contacting surface 76 for contact with either the moving web or a moving fabric, belt, or wire. Sealing member 74 can be flexible and can be abrasion resistant, and can comprise an abrasion resistant layer of material such as silicon nitride or ceramic connected to a more flexible material such as plastic. Sealing member 74 is joined to a movable body 72 which can move relative to a support base or support element 70. A chamber 80 is defined by the internal walls of the support base 70 and the movable body 72. Chamber 80 can be pressurized by injection of fluid such as water, oil, or air through a fluid port 78 connected to a pressurized fluid source (not shown). Generally, the fluid for pressurizing chamber 80 is not associated with the fluid for pressurizing the web treatment chamber, but is isolated and separate. It can be delivered by means of hydraulic pistons, gas compressors, pumps, or the like, operatively associated with the controller (not shown) which directs the level of pressure to be applied to chamber 80, which desirably is just one of multiple independently pressurizable chambers along the length of the seal assembly. Movable body 72 can be flexible to allow one portion to be locally adjusted relative to other portions by controlling the internal pressure in discrete internal chambers 80, or can be segmented to allow independent application of force or position control of each segment. By adjusting the pressure in chamber 80, the local sealing force applied to the sealing member 74 is controlled, or, similarly, the position of sealing member 74 can be adjusted when it is opposed by a resisting force from a deformed web, for example.

Figure 4:
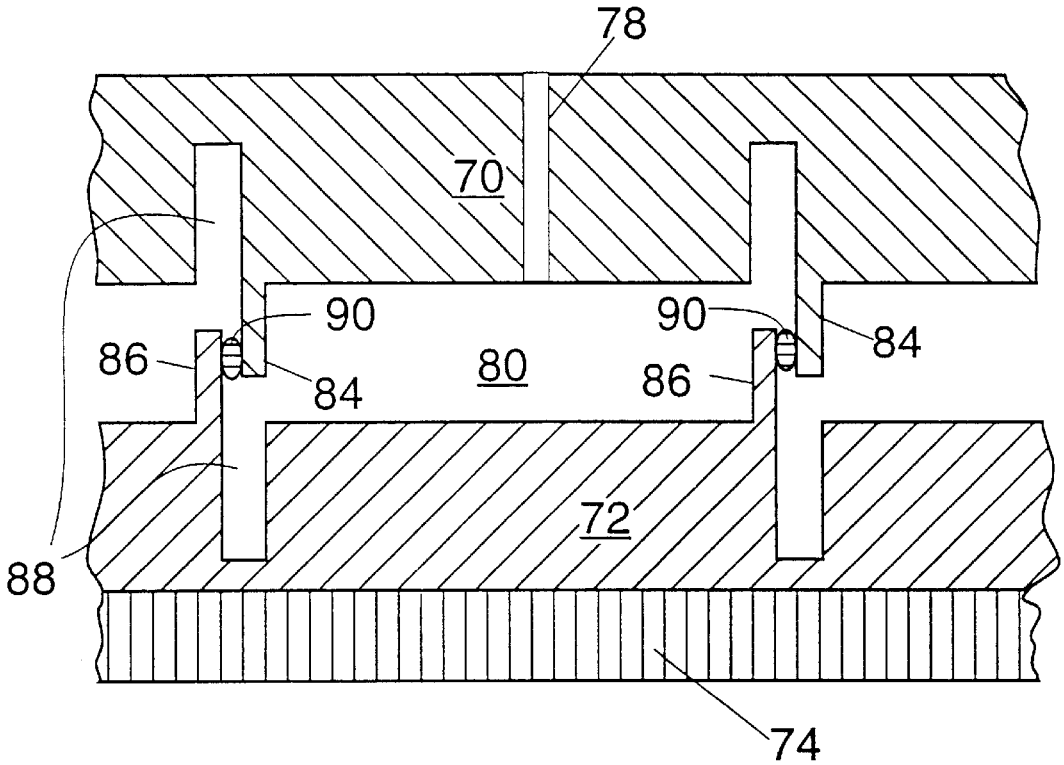
FIG. 4 shows an enlarged portion of the seal head and support plate of FIG. 3 in the plane of line 44 illustrating the isolated pressurization chambers in the cross-direction.

FIG. 4 shows an enlarged portion of the cross-section view taken in the plane of line 4—4 in FIG. 3, offering a view normal to the sealing axis of the seal head 69, which, in this case, is segmented. FIG. 4 depicts how chamber 80 for one segment of a seal is isolated from other segments to permit local control of sealing pressure. In this embodiment where the seal head 69 in FIG. 3 extends in the cross-direction, the view in FIG. 4 is taken in the machine direction. Chamber 80 between the support base 70 and the movable body 72 is shown, as is the fluid port 78. Chamber 80 has a finite extent along the sealing axis and is bound by wall elements 84 and 86 integrally connected respectively to the support base 70 and the movable head 72. Between the adjoining wall elements 84 and 86 is an internal sealing element 90 which separates one pressurized chamber 80 from the surrounding pressurized chambers, allowing different sealing pressures to be applied to various portions of the seal assembly. Sealing element 90 can be an O-ring, a gasket, a flexible strip, an inflatable member, other mechanical seals, or can represent any kind of sealing contact between adjoining wall elements 84 and 86 such that chamber 80 is substantially independently pressurizable relative to adjoining chambers. Movable head 72 can move or slide relative to support base 70, with a wide range of motion made possible by internal wells 88 which can receive the protruding wall elements 84 and 86.

In FIGS. 3 and 4, the movable head can be a contiguous beam that is flexible along the sealing axis for localized sealing control, or can comprise discrete sections that can move independently in the sealing direction (normal to the web) for fine localized control.

It will be appreciated that details of the foregoing embodiments, given for purposes of illustration, are not to be construed as limiting the scope of this invention. Although only a few exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention, which is defined in the following claims and all equivalents thereto. Further, it is recognized that many embodiments may be conceived that do not achieve all of the advantages of some embodiments, particularly of the preferred embodiments, yet the absence of a particular advantage shall not be construed to necessarily mean that such an embodiment is outside the scope of the present invention.

We claim:

1. A control system for detecting and reducing fluid leaks along a seal between a moving fabric web and a web treatment chamber, wherein the web treatment chamber comprises a plenum for applying a fluid at a pressure other than the ambient pressure to a surface of the moving fabric web to directly contact the moving fabric web, and a seal between the plenum and the moving fabric web, the control system comprising:

(a) a leak detector mounted near the seal, adapted to produce a signal to indicate the presence and location of a fluid leak between the moving fabric web and the seal; and (b) localized leak reduction means responsive to the signal produced by the leak detector.

2. The control system of claim 1, wherein the leak detector comprises acoustic sensors.

3. The control system of claim 1, wherein the leak reduction means comprises a multiplicity of sealing elements which apply variable sealing pressure to the seal.

4. The control system of claim 1, wherein the leak reduction means comprises a force distribution actuator which applies locally variable force to the seal.

5. The control system of claim 1, wherein the leak detector produces an electrical signal and the leak reduction means responds to the electrical signal.

6. The control system of claim 1, wherein the web treatment chamber applies a reactive chemical to the moving fabric web.

7. The control system of claim 1, wherein the web treatment chamber further comprises an opposing chamber for removing the applied fluid from the plenum, wherein the plenum is in a facing, cooperative relationship with the opposing chamber disposed such that the moving fabric web passes between the plenum and the opposing chamber.

8. The control system of claim 7, wherein the opposing chamber is a vacuum box.

9. The control system of claim 1, wherein the moving fabric web is a nonwoven web.

10. The control system of claim 1, wherein the localized leak reduction means comprises a force generator for adjusting local sealing force on the seal.

11. The control system of claim 10, wherein the force generator is selected from thermal expanding rods, thermal expanding beam elements, thermal hydraulic actuators, mechanical actuators, motors, piezoelectric elements, air bags, air hoses, gas cylinders, pneumatic pistons, hydraulic pistons, thermoelectric actuators, mechanical screws, gear assemblies, pulley assemblies, lever and fulcrum assemblies, adjustable spring assemblies, screw and jack assemblies, and magnetic force generation systems.

12. The control system of claim 1, wherein the plenum is at a pressure lower than atmospheric pressure.

13. The control system of claim 1, wherein the plenum is at a pressure greater than atmospheric pressure.

14. The control system of claim 1, having a Local Sensitivity of 20 or less.

15. A method for reducing leaks in a pressurized web treatment system for treating a moving fabric web with a pressurized fluid, the web treatment system comprising a pressurized chamber, a seal between the moving fabric web and the pressurized chamber, a leak detector positioned near the seal, and means for removing the pressurized fluid from the web treatment system, the method comprising:

(a) detecting a leak along the seal with the leak detector;

(b) identifying the approximate location of the leak;

(c) generating a signal indicative of the approximate location of the leak; and (d) increasing local sealing pressure above a predetermined minimum along the seal in the approximate location of the leak responsive to the signal.

16. The method of claim 15, further comprising incrementally reducing the local sealing pressure in the region where sealing pressure was previously increased until leakage in said region begins to increase, then increasing the sealing pressure again slightly to a level before increased leakage was detected, whereby excessive sealing pressures are avoided.

17. A pressurized web treatment system for applying a pressurized fluid from a fluid source to a moving fabric web while dynamically reducing fluid leaks to the atmosphere, comprising:

(a) a web treatment chamber comprising chamber walls that define an interior plenum, a fluid inlet for receiving pressurized fluid from a fluid source, an opening for applying pressurized fluid to a moving fabric web, a leading edge and a trailing edge both extending in the cross direction, opposing side edges extending in the machine direction, and a flexible seal assembly along at least one of the leading edge, the trailing edge, and the side edges, the seal assembly comprising a first seal head in contact with the web treatment chamber and an opposing second seal head with the moving fabric web passing between the first and second seal heads and wherein one of the first and second seal heads is urged toward the other of the first and second seal heads with a sealing force, and means for removing the applied fluid from the web treatment chamber; and (b) a control system for reducing fluid leaks along the seal assembly comprising a leak detector for identifying the presence and location of a fluid leak between the moving fabric web and the seal assembly, and localized leak reduction means responsive to the leak detector, wherein the localized leak reduction means comprises a force generator for variably adjusting the sealing pressure along the length of the seal assembly to reduce leakage in the vicinity of the fluid leak as identified by the leak detector.

18. A treatment system for a moving fabric web having a first surface and a second surface, comprising:

(a) a chamber comprising a plenum for pressurized fluid in fluid communication with the moving fabric web, the chamber having at least one edge along which the moving fabric web travels into or out of the chamber;

(b) a flexible seal assembly in contact with said at least one edge for preventing leakage of pressurized fluid from the treatment system;

(c) a leak detector responsive to fluid leaks along the seal assembly such that the approximate location of fluid leaks can be identified;

(d) localized leak reduction means along the seal assembly cooperatively associated with the leak detector such that increased sealing force is applied where leaks occur; and (e) means for removing the applied fluid from the web treatment system.

19. The treatment system of claim 18 wherein the leak reduction means has a Local Sensitivity of three or greater.

20. The control system of claim 18, having a Local Sensitivity of 20 or less.

21. A control system for detecting and reducing fluid leaks along a seal between a moving fabric web and a web treatment chamber, wherein the web treatment chamber comprises a pressurized plenum for applying a fluid at a pressure greater than the ambient pressure to a surface of the moving fabric web to directly contact the moving fabric web, a seal between the plenum and the moving fabric web, and an opposing chamber for removing the applied fluid from the pressurized plenum, the control system comprising:

(a) a leak detector mounted near the seal, adapted to produce a signal to indicate the presence and location of a fluid leak between the moving fabric web and the seal; and (b) localized leak reduction means responsive to the signal produced by the leak detector.

22. The control system of claim 21, having a Local Sensitivity of 20 or less.

23. The control system of claim 21, wherein the moving fabric web moves through the web treatment chamber while in contact with at least one additional fabric web.

24. The control system of claim 21, wherein the seal comprises a friction resistant material selected from at least one of Teflon, a fluoropolymer, a ceramic, and a material comprising a surface having at least one of a nitride, carburized steel, diamond, and a plasma-deposited agent.

25. The control system of claim 21, wherein the seals are cooled.

26. The control system of claim 21, wherein the seals are lubricated with lubrication means.

* * * * *